US008714857B1

(12) United States Patent
Liu

(10) Patent No.: US 8,714,857 B1
(45) Date of Patent: May 6, 2014

(54) LEAK-PROOF CONTAINER FOR A LIQUID COSMETIC PRODUCT

(71) Applicant: Li-Mei Liu, Diamond Bar, CA (US)

(72) Inventor: Li-Mei Liu, Diamond Bar, CA (US)

(73) Assignee: Allen & Thomas Cosmetic Accessories Co., Ltd., Zhuhai (CN)

( * ) Notice: Subject to any disclaimer, the term of this patent is extended or adjusted under 35 U.S.C. 154(b) by 0 days.

(21) Appl. No.: 13/797,707

(22) Filed: Mar. 12, 2013

(51) Int. Cl.
*A46B 17/04* (2006.01)

(52) U.S. Cl.
USPC ..... 401/269; 401/28; 401/262; 401/213; 401/183

(58) Field of Classification Search
CPC ..... B43K 23/08; B43K 23/10; B43K 23/12; B43K 23/128; B65D 5/64; B65D 5/68; A61H 2201/105; A46B 17/04
USPC ..... 401/28, 98, 183, 202, 213, 243, 247, 401/262, 269
See application file for complete search history.

(56) References Cited

U.S. PATENT DOCUMENTS 4,823,777 A * 4/1989 Goncalves et al. ..... 601/154
5,971,647 A * 10/1999 Loulourgas ..... 401/202
7,614,814 B2 * 11/2009 Lee et al. ..... 401/269
8,281,962 B2 * 10/2012 Ogawa et al. ..... 222/501

* cited by examiner

*Primary Examiner* — David Walczak
(74) *Attorney, Agent, or Firm* — Che-Yang Chen; Law Office of Michael Chen

(57) ABSTRACT

A leak-proof container for a liquid cosmetic product is provided with a cap assembly including a cap and a spring activated retaining ring moveably secured to the cap; a dispensing assembly including a flexible dome, a hollow seat, and an applicator retained in the dome wherein the seat is partially disposed in the dome and includes a hollow shank, and a sealing member put on an upper portion of the seat to block any leaking paths through a joining surface of the dome and the seat wherein a bottom of the seat is seated on an intermediate, annular protruding member on an inner surface of the dome in a friction fit; and a reservoir assembly including a shell and a liquid reservoir including a top bossed opening, the reservoir disposed in the shell and the shank lockingly inserted into the bossed opening.

10 Claims, 6 Drawing Sheets

LEAK-PROOF CONTAINER FOR A LIQUID COSMETIC PRODUCT

BACKGROUND OF THE INVENTION

1. Field of the Invention

The invention relates to containers for liquid cosmetic products and more particularly to a leak-proof container for a liquid cosmetic product.

2. Description of Related Art

Conventionally, containers for liquid cosmetic products are not leak-proof. It is often that liquid contained in a reservoir of the container for liquid cosmetic product may leak if sufficient care is not taken. Further, cleaning the leaked liquid prior to using is a tedious thing.

Moreover, the conventional type of container for a liquid cosmetic product is equipped with a permanently fastened applicator. That is, a replacement of the applicator with any of other types of applicator is impossible. It is monotonous.

Thus, the need for improvement still exists.

SUMMARY OF THE INVENTION

It is therefore one object of the invention to provide a container for a liquid cosmetic product comprising a cap assembly comprising a cap and a retaining ring wherein the cap, on an inner surface, includes a first rail on one side, a second rail on an opposite side, and a bossed hole projecting downward; the retaining ring includes a hollow shaft projecting upward from a top to insert into the bossed hole, and two opposite grooves for receiving the first and second rails; and a spring member put on the shaft and biased between the top of the retaining ring and a bottom of the bossed hole so that the first and second rails are capable of sliding in the grooves; a dispensing assembly comprising a flexible dome, a hollow seat, and an applicator retained in the dome wherein the dome includes an intermediate, annular protruding member on an inner surface; and the seat is partially disposed in the dome and includes a hollow shank having a channel, and a sealing member sealingly put on an upper portion of the seat to block any leaking paths through a joining surface of the dome and the seat wherein a bottom of the seat is seated on the intermediate, annular protruding member in a friction fit; and a reservoir assembly comprising a liquid reservoir and a shell wherein the liquid reservoir includes a chamber, and a bossed opening on a top wherein the liquid reservoir is disposed in the shell and the shank of the seat is lockingly inserted into the bossed opening; wherein the cap is lockingly put on the dome, and the dome is lockingly put on the shell.

The above and other objects, features and advantages of the invention will become apparent from the following detailed description taken with the accompanying drawings.

DETAILED DESCRIPTION OF THE INVENTION

Figure 1:
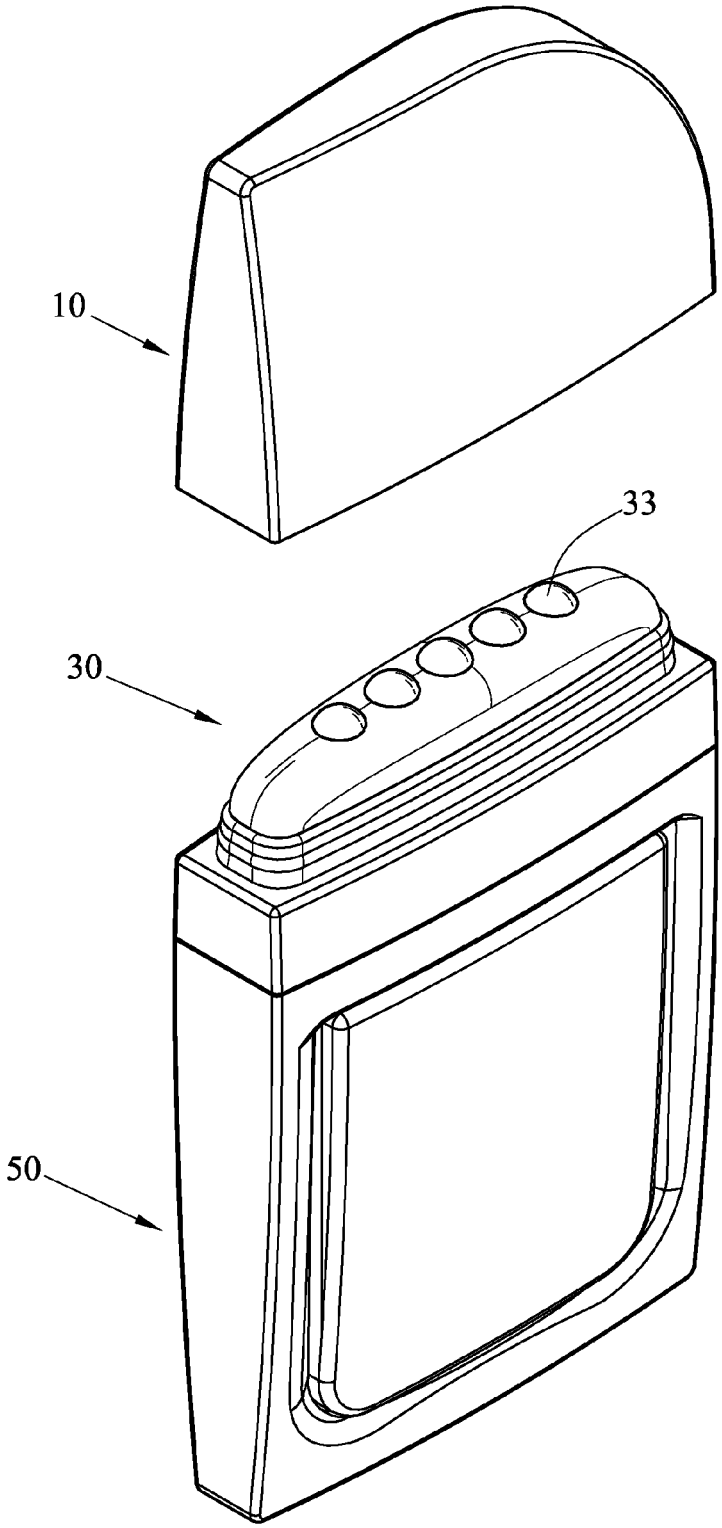
FIG. 1 is an exploded perspective view of a leak-proof container for a liquid cosmetic product according to a first preferred embodiment of the invention.
Figure 2:
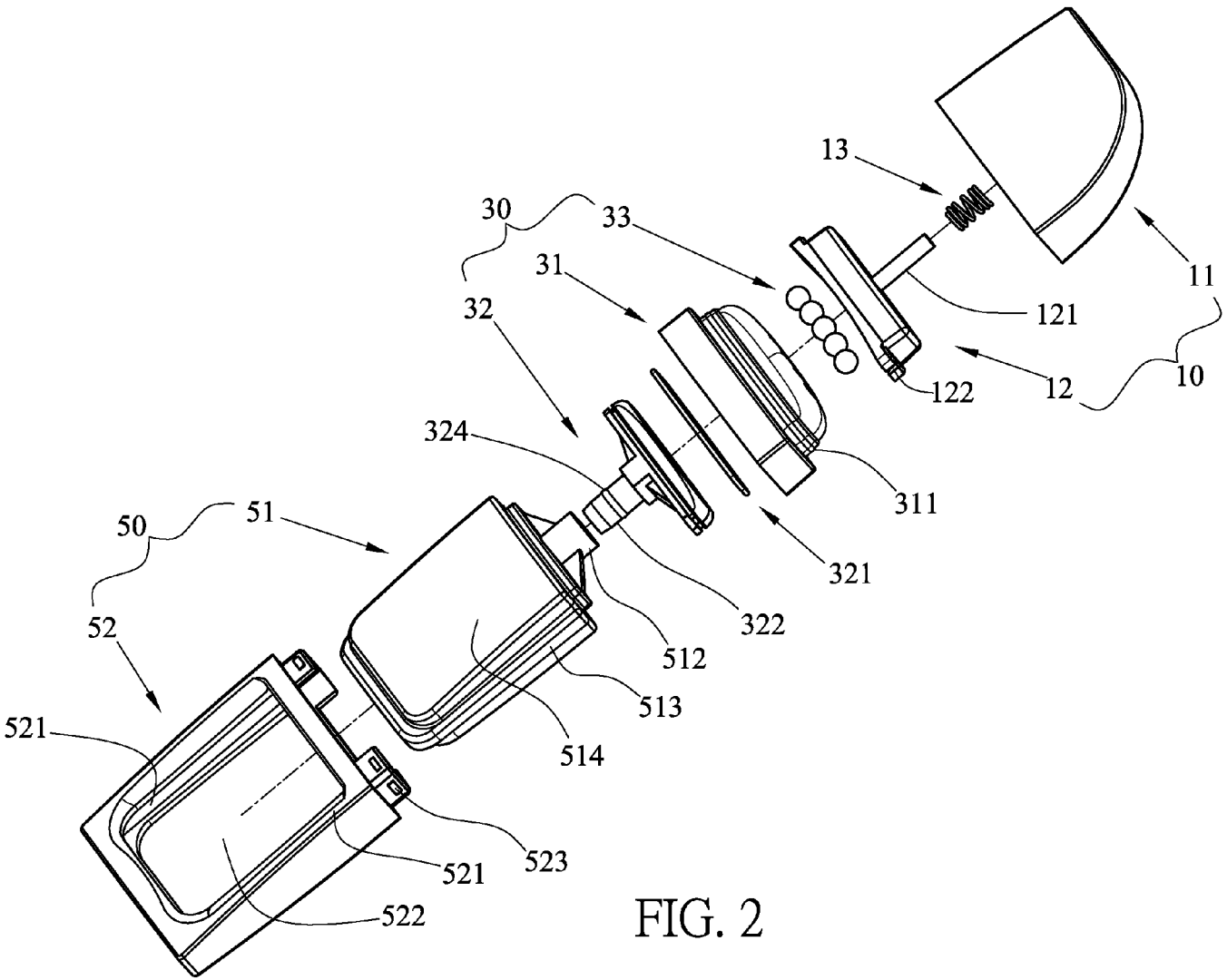
FIG. 2 is an exploded view of the container.
Figure 3:
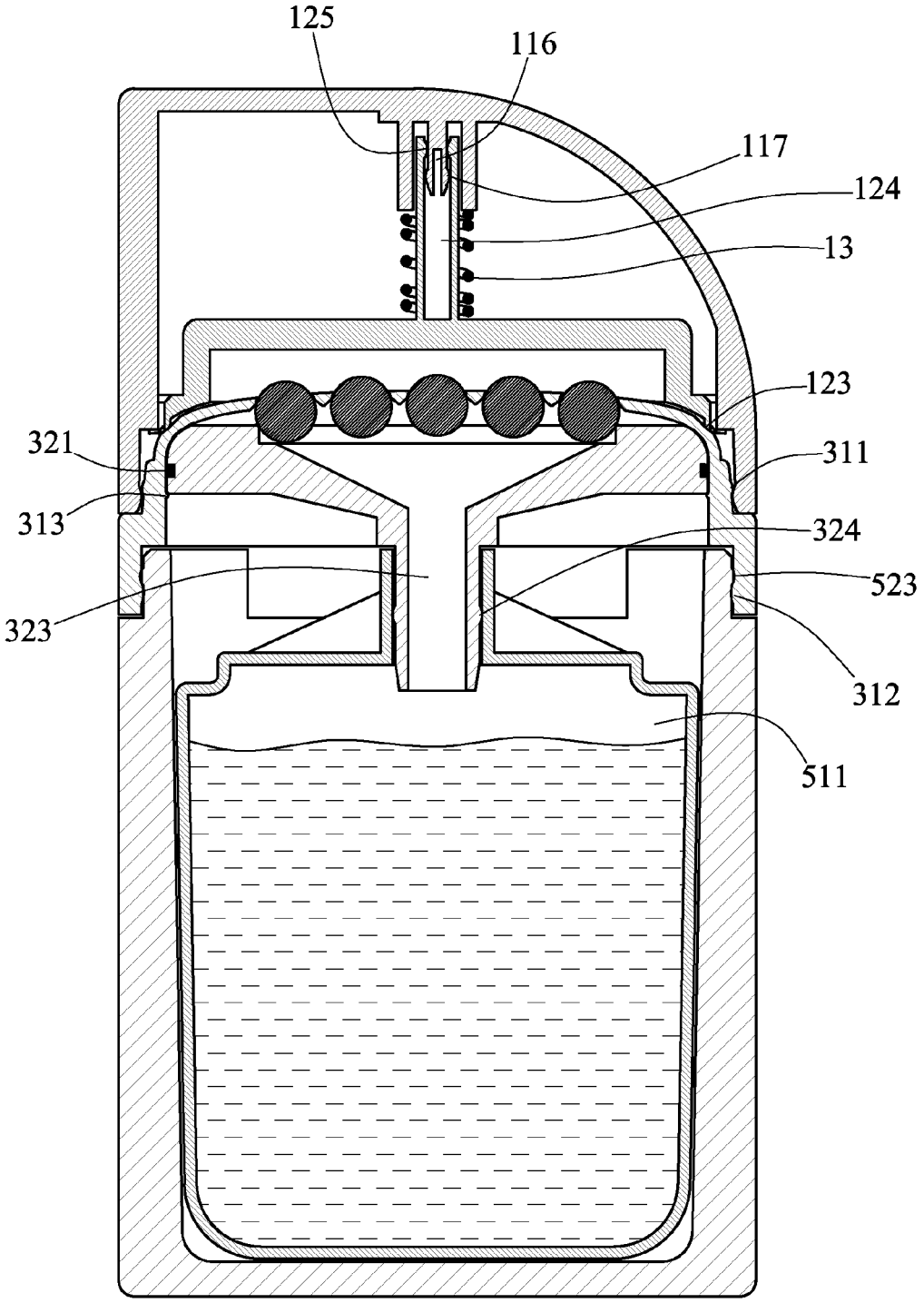
FIG. 3 is a longitudinal sectional view of the assembled container.

Referring to FIGS. 1 to 4, a leak-proof container for a liquid cosmetic product in accordance with a first preferred embodiment of the invention comprises the following components as discussed in detail below.

A cap assembly 10 comprises a cap 11, on an inner surface, including an annular protrusion 111, an annular projection 112 proximate to a bottom edge, a first rail 113 on one side, a second rail 114 on an opposite side, a bossed hole 115 projecting downward from a center, an opening 116 defined by the bossed hole 115, and a latch 117 projecting downward from a center of a bottom of the opening 116; a retaining ring 12 including a hollow shaft 121 projecting upward from a top to insert into the bossed hole 115 with the latch 117 disposed therein, a hole 124 formed in the shaft 121, an annular protuberance 125 proximate a top edge of the shaft 121 for retaining the latch 117 (i.e., the cap 11 and the retaining ring 12 being assembled), opposite grooves 122 for receiving the first and second rails 113, 114, and an annular sealing member 123 on a bottom edge; and a compression spring 13 put on the shaft 121 and biased between the top of the retaining ring 12 and a bottom of the bossed hole 115. As a result, the retaining ring 12 is a spring biased member to be slidable in the cap 11. That is, the first and second rails 113, 114 are adapted to slide in the grooves 112.

A dispensing assembly 30 comprises a flexible dome 31 including an annular projecting member 311 on an intermediate portion of an outer surface, a lower, annular projecting element 312 on an inner surface, and an intermediate, annular protruding member 313 on the inner surface about flush with the projecting member 311; a hollow seat 32 partially disposed in the dome 31 and including a hollow shank 322 having a channel 323, an annular protruding element 324 on an intermediate portion of an outer surface of the shank 322, and a sealing member (e.g., O-ring) 321 put on an upper portion of the seat 32 to block any possible leaking paths through a joining surface of the dome 31 and the seat 32; and a plurality of balls 33 retained in the dome 31. Further, a bottom of the seat 32 is seated on the intermediate, annular protruding member 313 in a friction fit.

The projecting member 311 and the projection 112 are tightly engaged, and the sealing member 123 is urged against the top of the dome 31. Thus, any gaps between the ball 33 and the dome 31 are blocked and a sealing engagement of the cap assembly 10 and the dispensing assembly 30 is achieved.

A flat, rectangular reservoir assembly 50 comprises a flexible liquid reservoir 51 including a chamber 511 for containing a quantity of liquid, a bossed opening 512 on a top, a U-shaped flange 513 on an outer surface of the chamber 511, and two projecting portions 514 on both sides of the flange 513; and a shell 52 including a slot 521 on an inner surface, two openings 522 on both sides of the shell 52 respectively, and a plurality of snapping members 523 projecting out of a top of the shell 52. In an assembly, the liquid reservoir 51 is disposed in the shell 52 with the flange 513 received in the slot 521, and the projecting portions 514 project out of the openings 522. Further, in an assembly of the reservoir assembly 50 and the dispensing assembly 30, the shank 322 is inserted into the bossed opening 512 with the protruding element 324 lockingly fastened in the bossed opening 512, and the snapping members 523 are tightly engaged with the projecting element 312. This completes a sealing assembly of the invention (i.e., being leak-proof when liquid is stored in the chamber 511).

Figure 4:
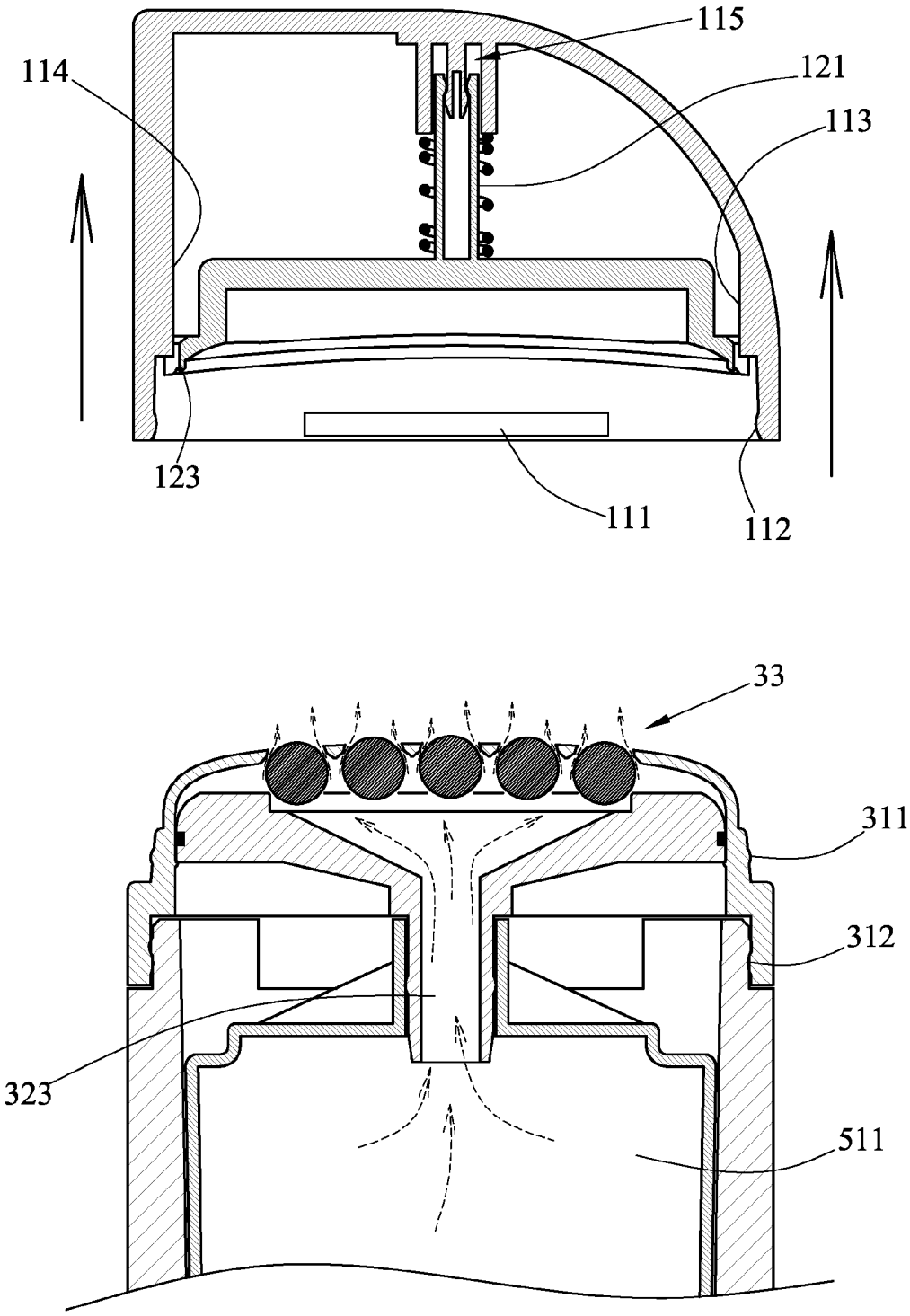
FIG. 4 is a view of the intermediate and upper portions of FIG. 3 showing the fluid flowing out of the container after detaching the cap.

In use (as shown in FIG. 4), an individual may pull the cap assembly 10 upward to detach the cap assembly 10 from the remaining parts of the container. And in turn, the dome 31 returns to it uncompressed state due to the nature of a flexible member. Thus, a plurality of flow paths are formed through gaps between the balls 33 and the dome 31. As an end, liquid (e.g., lotion) contained in the chamber 511 of the liquid reservoir 51 flow upward through the channel 323. Finally, the liquid flows through the gaps between the balls 33 and the dome 31 to be applied on the body.

Figure 5:
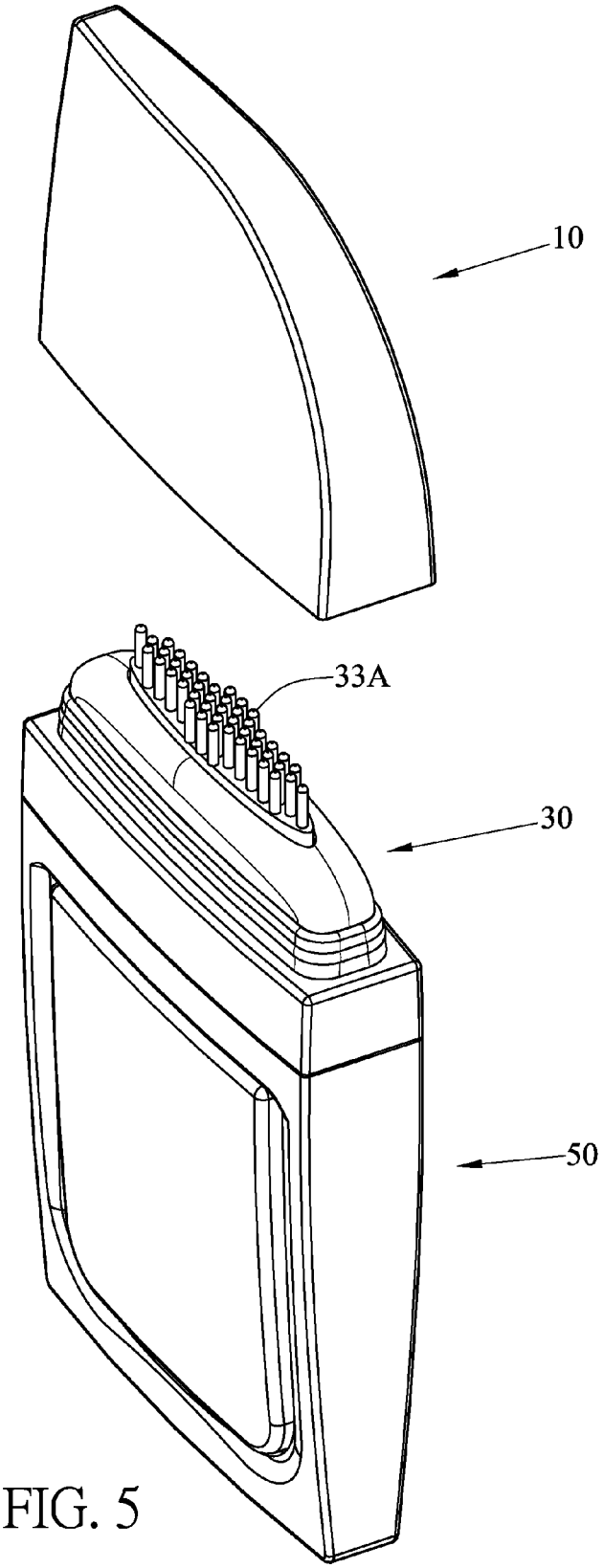
FIG. 5 is an exploded perspective view of a leak-proof container for a liquid cosmetic product according to a second preferred embodiment of the invention.

Referring to FIG. 5, a leak-proof container for a liquid cosmetic product in accordance with a second preferred embodiment of the invention is shown. The characteristics of the second preferred embodiment are substantially the same as that of the first preferred embodiment except the following: The balls are replaced with a silicone rubber head 33A.

Figure 6:
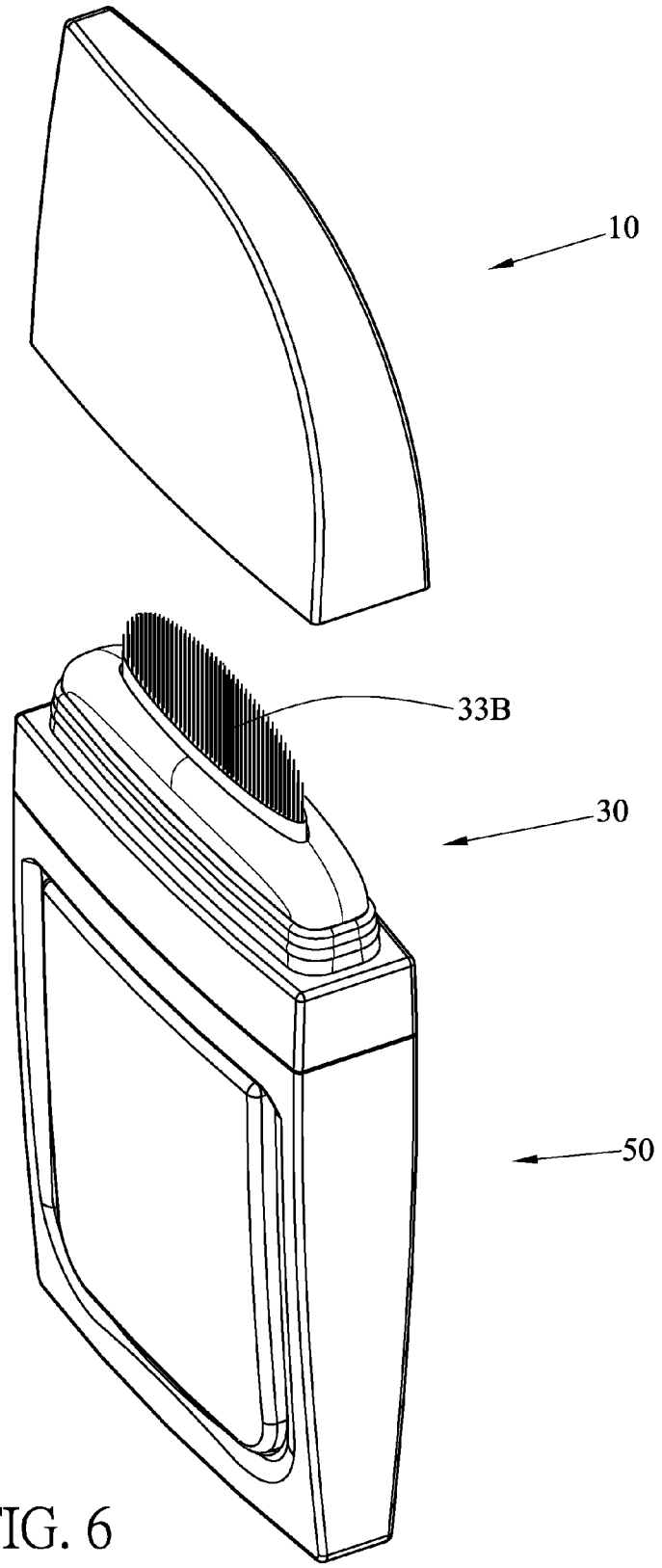
FIG. 6 is an exploded perspective view of a leak-proof container for a liquid cosmetic product according to a third preferred embodiment of the invention.

Referring to FIG. 6, a leak-proof container for a liquid cosmetic product in accordance with a third preferred embodiment of the invention is shown. The characteristics of the third preferred embodiment are substantially the same as that of the first preferred embodiment except the following: The balls are replaced with a plurality of brushes 33B. Alternatively, the balls are replaced with a head having a plurality of openings (not shown) in another preferred embodiment. Both can satisfy the needs of consumers.

While the invention has been described in terms of preferred embodiments, those skilled in the art will recognize that the invention can be practiced with modifications within the spirit and scope of the appended claims.

What is claimed is:

1. A container for a liquid cosmetic product comprising:

a cap assembly comprising a cap and a retaining ring wherein the cap, on an inner surface, includes a first rail on one side, a second rail on an opposite side, and a bossed hole projecting downward; the retaining ring includes a hollow shaft projecting upward from a top to insert into the bossed hole, and two opposite grooves for receiving the first and second rails; and a spring member put on the shaft and biased between the top of the retaining ring and a bottom of the bossed hole so that the first and second rails are capable of sliding in the grooves;

a dispensing assembly comprising a flexible dome, a hollow seat, and an applicator retained in the dome wherein the dome includes an intermediate, annular protruding member on an inner surface; and the seat is partially disposed in the dome and includes a hollow shank having a channel, and a sealing member sealingly put on an upper portion of the seat to block any leaking paths through a joining surface of the dome and the seat wherein a bottom of the seat is seated on the intermediate, annular protruding member in a friction fit; and a reservoir assembly comprising a liquid reservoir and a shell wherein the liquid reservoir includes a chamber, and a bossed opening on a top of the chamber wherein the liquid reservoir is disposed in the shell and the shank of the seat is lockingly inserted into the bossed opening;

wherein the cap is lockingly put on the dome, and the dome is lockingly put on the shell.

2. The container of claim 1, wherein the cap further comprises an annular protrusion on the inner surface, and an annular projection on the inner surface proximate to a bottom; and the dome further comprises an annular projecting member on an intermediate portion of an outer surface, the annular projecting member being lockingly secured to both the annular protrusion and the annular projection.

3. The container of claim 1, wherein the bossed hole comprises an opening and a latch projecting downward from a bottom of the opening; and the retaining ring further comprises an annular protuberance proximate a top of the shaft for retaining the latch so as to hold secure the retaining ring.

4. The container of claim 1, wherein the dome further comprises a lower, annular projecting element on the inner surface; and wherein the shell comprises a plurality of snapping members projecting out of a top, the snapping members being lockingly engaged with the projecting element.

5. The container of claim 1, wherein the applicator is a plurality of balls, a silicone rubber head, or a plurality of brushes.

6. The container of claim 1, wherein the sealing member is an O-ring.

7. The container of claim 1, wherein the shank comprises an annular protruding element on an intermediate portion of an outer surface, and wherein the shank being is inserted into the bossed opening with the protruding element lockingly fastened in the bossed opening.

8. The container of claim 1, wherein the liquid reservoir is flexible.

9. The container of claim 1, wherein the liquid reservoir further comprises a U-shaped flange on an outer surface of the chamber, and two projecting portions on both sides of the flange respectively; wherein the shell includes a slot on an inner surface, and two openings on both sides of the shell respectively; and wherein the flange is received in the slot, and the projecting portions project out of the openings of the shell.

10. The container of claim 1, wherein the chamber is capable of containing a quantity of lotion.

* * * * *

UNITED STATES PATENT AND TRADEMARK OFFICE

CERTIFICATE OF CORRECTION

PATENT NO. : 8,714,857 B1
APPLICATION NO. : 13/797707
DATED : May 6, 2014
INVENTOR(S) : Li-Mei Liu

It is certified that error appears in the above-identified patent and that said Letters Patent is hereby corrected as shown below:

On the Title Page, Item (71) the Applicant should read
--(71) Applicant: Li-Mei Liu, Zhuhai, CHINA On the Title Page, Item (72) the Inventor should read
--(72) Inventor: Li-Mei Liu, Zhuhai, CHINA Signed and Sealed this
Sixteenth Day of September, 2014

Michelle K. Lee

Michelle K. Lee
*Deputy Director of the United States Patent and Trademark Office*